United States Patent [19]

Holy

[11] Patent Number: 4,682,774

[45] Date of Patent: Jul. 28, 1987

[54] COLLAPSIBLE, RE-COMBINATIVE MARTIAL-ARTS WEAPON

[75] Inventor: Stephen M. Holy, Urbana, Ill.

[73] Assignees: Joseph Arvidson; Sharon K. Wells; Thomas E. Skoza, all of Champaign, Ill.

[21] Appl. No.: 793,271

[22] Filed: Oct. 31, 1985

[51] Int. Cl.[4] ..... A63B 59/00

[52] U.S. Cl. ..... 273/84 R; 273/67 R; 272/123

[58] Field of Search ..... 273/84 R, 416, 67 A, 273/1 G, 1 GH, 1 GE, 419, ; 135/74, 15 PQ; 272/1 B, 76, 901

[56] References Cited

U.S. PATENT DOCUMENTS

| | | | |
|---|---|---|---|
| 3,703,011 | 11/1972 | Goggi et al. | 273/67 R |
| 3,934,877 | 1/1976 | White | 273/84 A |
| 4,070,023 | 1/1978 | Cutler | 273/84 A |
| 4,132,408 | 1/1979 | Sabat | 273/84 A |

FOREIGN PATENT DOCUMENTS

| | | | |
|---|---|---|---|
| 14352 | 7/1908 | United Kingdom | 273/416 |

OTHER PUBLICATIONS

Black Belt magazine article, "Vari-Weight Nunchaku", Aug. 1984, Scientific Library.

Black Belt magazine article, "New Concepts", Mar. 1976, p. 27, Scientific Library.

*Primary Examiner*—Richard C. Pinkham

*Assistant Examiner*—Gary Jackson

*Attorney, Agent, or Firm*—Marvin N. Benn; Milton S. Gerstein

[57] ABSTRACT

A number of component parts may be recombined to form a number of different martial-arts weapons. The many different types of weapons that may be formed is achieved via three elongated basic components interconnected together by male and female couplers, and a number of secondary components also connected to the three basic components by male and female couplers. One secondary component is chain for connection to one end of a basic component or between adjacent ends of two basic components. A number of other secondary components allows for many other different weapons to be formed. The recombinative and collapsible nature of the components also allows for ease of transport.

6 Claims, 17 Drawing Figures

10
12
14
14'
16
16'
17
18
19
20
24
24'
26
30
30'
32

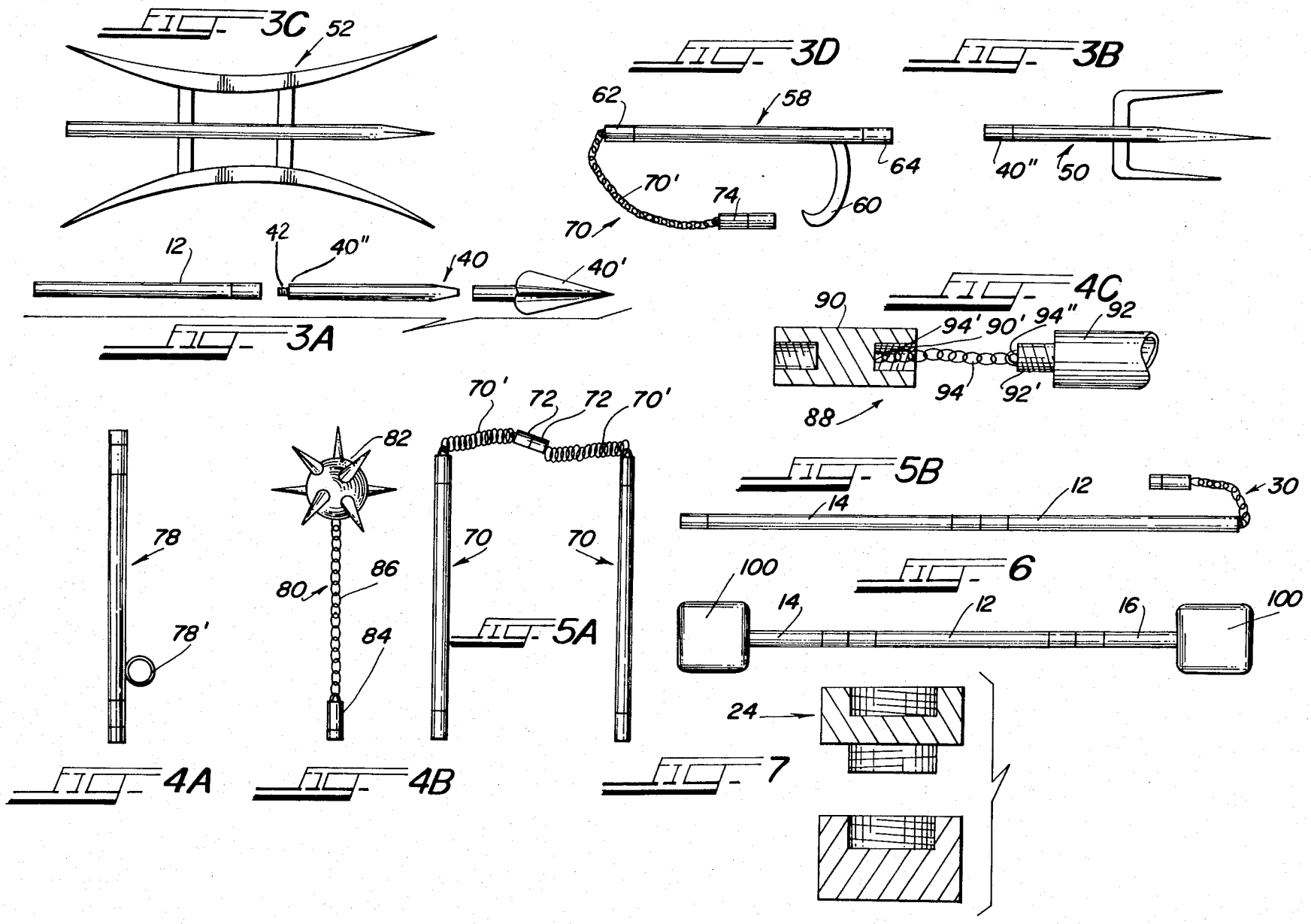
3B
50
40"
4C
92
94"
90'
92'
94'
94
90
88
30
12
5B
14
100
16
6
12
14
100
24
7
64
60
3D
58
74
70'
62
70
40'
70'
72
72
70'
70
70
5A
40
40"
42
3A
12
82
86
84
80
4B
3C
52
78
78'
4A

COLLAPSIBLE, RE-COMBINATIVE MARTIAL-ARTS WEAPON

BACKGROUND OF THE INVENTION

The present invention is directed to a martial-arts weapon for use in martial-arts exercises that is capable of being combined into a number of different types of martial-arts weapons, such as an escrima stick, bo, jo, tonfa, pugil stick, nunchaku, three-sectional staff, hanbo, staff with spear-tip, shikibo, mace-and-chain, and others. Each of these above-named types of martial-arts weapons is used in competition by a skilled martial-arts practitioner for displaying his adeptness, agility, confidence, and speed in using each or all of the above-named types of weapons. The practitioner is rated by a panel of judges who scores the practitioner by his skill in the above-named areas of use.

There are many different types of martial-arts weapons available to a martial-arts practitioner. Those weapons in which one chooses to become proficient are usually those weapons the practitioner either has in his possession, may readily borrow, or may purchase at a reasonable price. However, since there are very many different weapons available, and since many of them are not inexpensive, each practitioner is limited in the number of such weapons in which he may become adept. Further, each weapon is cumbersome, ofttimes heavy, and, thus, usually difficult to transport from one site to another, as, for example, from the practitioner's home or gym to a location where a competition is being held.

SUMMARY OF THE INVENTION

It is, therefore, the primary objective of the present invention to provide a martial-arts weapon that is capable of being disassembled for easy carrying from one location to a remote location.

It is also another primary objective of the present invention to provide a martial-arts weapon that is capable of being re-combined into a number of different types of martial-arts weapons, so that by using a specified number of basic components, a plurality of different martial-arts weapons may be formed, while still allowing for the easy carrying and transport thereof.

It is still another objective of the present invention to provide a collapsible, recombinative martial-arts weapon that is easy to assemble and disassemble.

It is yet another objective of the present invention to provide a collapsible martial-arts weapon that allows for the placement of the hands of a practitioner using the weapon at those locations where the component-parts are joined, so that the placement of the hands may be more readily and easily noticeable by a panel of judges judging a competition.

Toward these and other ends, the collapsible and re-combinative martial-arts weapon of the present invention includes a first set of basic components that, when connected together, form a "BO", which is a stick approximately six feet long. This is comprised of a center-section removably coupled to a pair of end-sections by mating male-female connections. The stick may be disassembled into three components parts, each of them the same length. The two end-sections may also be removably-coupled together to form a "jo". Each of the basic components are also provided with end-caps for closing each end of the components. Special attachments are also provided for forming additional martial-arts weapons. A chain-component that is connectable between one end of the center-piece component and an adjacent end of one of the end-piece components allows for the formation of a three-sectional staff that may take a number of different configurations. The same chain component may be used to form a "Nunchaku", when only one end-piece with mating center piece is used. An end-piece may also be replaced by any one of a series of blade components to form a spear, Sai, Juttle, Moon Ax, and the like. A mace-and-chain component is provided having a mace attached to a chain, which chain has at its end a fitting for coupling to an end of the center-piece component or an end-piece component. Other additional components are also provided.

In a modification of the invention, each end-piece component and the center-piece component are provided with removable male or female couplers, so that each end of these components may be provided with a desired type of coupling, in order to allow for the attachment thereto of an additional component having its own specific male or female-type coupler.

The ends of each basic component that contain the specific type of coupler is differentiated from the remainder of the component, which ends usually are the portions of the components at which the hands of the practitioner are placed, so that a panel of judges may more readily and easily guage the hand-coordination and hand-positioning of the practitioner during his exercise in a competition.

BRIEF DESCRIPTION OF THE DRAWING

The invention will be more readily understood with reference to the accompanying drawing, wherein

FIG. 3A is an assembly view showing an additional component in the form of a spear for attachment to an end of the center-piece component of FIG. 1A instead of one of the end-piece components;

FIG. 3B is another additional component similar to that of FIG. 1A but in the form of a sai;

FIG. 3C is another additional component similar to that of FIG. 3A but in the form of a Chinese lance;

FIG. 3D is still another additional component in the form of a handle called a kama with a chain, for coupling to an end of one of the basic components;

FIG. 4A is a plan view of yet another additional component called a shikibo, which is a modification of the basic center-piece component of FIG. 1 in that a ring for the holding thereof by a finger is provided;

FIG. 4B is a plan view of an additional component called a mace-and-chain for coupling to an end of one of the three basic components of FIG. 1A;

FIG. 4C is a plan view of an additional component called a converta-chuck adapter which is coupled between two adjacent ends of the two basic end-piece components of FIG. 1A, such that a chain thereof is concealed inside the adjacent ends of the end-pieces when they are coupled together;

FIG. 5A is a plan view showing an additional component called an extended "nunchaku";

FIG. 5B is a plan view similar to FIG. 2C but with the chain-component mounted to only one end of an end-piece component to form a bo-chaku;

FIG. 6 is a plan view showing the foam-pad components of the present invention for attachment to the remote ends of the end-piece components separated by the center-piece component to form a pugil stick; and FIG. 7 is an assembly view showing a weighted end-cap component used to weigh down any end of a basic or additional component for use during training exercise.

DETAILED DESCRIPTION OF THE INVENTION

Figures 1A, 1B, 1C, 2A, 2B, 2C:
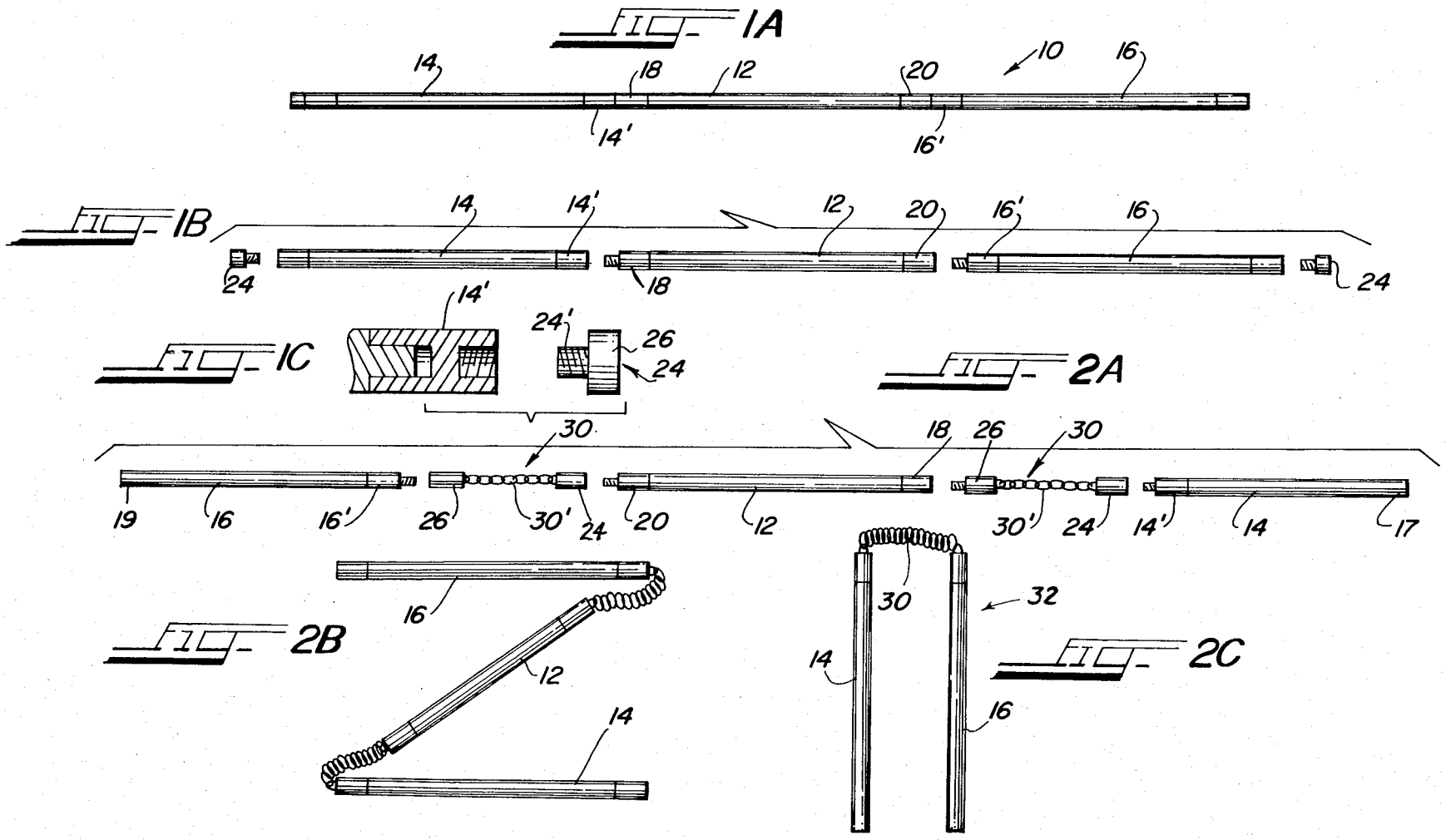
FIG. 1A is a plan view showing the three basic components of the present invention connected together to form a bo.
FIG. 1B is an assembly view showing the three basic components of the martial-arts weapon of FIG. 1A.
FIG. 1C is an assembly view showing a male end-cap of the present invention for insertion into a female-end of a basic or additional component of the martial-arts weapon of the present invention.
FIG. 2A is an assembly view showing the basic components of the present invention shown in FIG. 1A combined with a pair of chain-components to form a three-sectional staff.
FIG. 2B is a plan view showing one of the many configurations that the three-sectional staff of FIG. 2A may take.
FIG. 2C is a plan view showing the additional chain-component shown in FIG. 2A coupled between the two basic end-piece components to form a nunchaku.

Referring now to the drawings in greater detail, the collpasible, re-combinable martial-arts weapon of the present invention is indicated generally by reference numeral 10 in FIGS. 1A and 1B. The martial-arts weapon 10 consists of three basic components that are selectively coupled together to form a variety of different types of martial-arts weapons used in tournaments, exercises, and for self-defense in general. These three basic components are: The elongated center-piece component 12, and two elongated end-piece components 14 and 16. The center piece component 12 has a coupling element 18 and 20 at each end thereof, with coupling element 18 being a projecting, threaded male-coupler, while the coupling element 20 is a female-coupler with threaded opening for receiving a male-coupling element therein. The end-piece component 14 has a female-coupling element 14' at one end thereof for mating relationship with the male-coupling element 18, while the end-piece component 16 has a male-coupling element 16' for mating engagement with the coupling element 20. These three basic components are, therefore, combinable into a three-piece staff called a "bo", which is used as a weapon and used in karate tournaments, and the like, by which one may be judged by his proficiency in using the bo. Usually, the bo is six feet in length, so that each of the three basic components is two feet in length, in the preferred embodiment. The end-piece components 14 and 16 may be combined together, without the intervening center-piece component, via the mating couplers 14' and 16', in order to form a four-foot long stick called a "jo", another martial-arts weapon often used for displaying one's adeptness, agility, and proficiency in a tournament. In the embodiment shown in FIG. 1A, each end-piece component may be tapered toward an end thereof, though such is not necessary. The center-piece component 12 may also be used along, without attachment to another component, in order to serve as a night-stick for self-defense purposes or to serve as an "escrima stick". Alternatively, the "jo" may be formed by combining the center-piece component with one end-piece component.

In addition to these three-basic components of the invention, there are also provided a series of other additional, secondary components which unite with the three basic components to form other martial-arts weapons for use in exercises, tournament competition, and for self-defense. FIG. 1C shows an end-cap component for closing off one of a coupling element 14',16', 18, and 20, as well as other coupling elements secured to other additional components of the invention. The end-cap components come in two basic forms: The male-type cap 24 shown in FIG. 1C for attachment to and for closing off a female coupler, such as coupler 14'. The end-cap 24 includes a threaded shank 24' for mating engagement in a female coupler, and a head-portion 26 having the same outer diameter as the end of the component to which it is to be secured, so as to provide a finished and aesthetically-pleasing basic or additional component, as well as for concealing the free, unattached coupler to which it is attached, to thus prevent contact therewith. Each coupling element secured at an end of a component, whether a basic component or an additional, secondary component, also serves the function of providing a place upon which a hand may grip the weapon. Further, since each coupling element is made preferably of metal, and each basic component is made preferably of wood, the contrast thus provided allows for easy visual inspection by a panel of judges to ascertain the hand-positioning of the martial-arts practitioner during his floor exercise, which is used in judging the overall performance of the practitioner.

As mentioned previously, there are provided a number of additional, secondary components for use with the three basic components in order to form a number of different types of martial-arts weapons. One such secondary component 30 is shown in FIG. 2A in conjunction with the three basic components. The secondary component 30 is an elongated-link component with an elongated chain or cord 30' secured between two coupling components 24 and 26. The coupling component 24 is a female-coupler, while the coupler 26 is a male or female coupling component. The female coupler 26 mates with a male-coupling element, such as coupler 16', while the female coupler 24 mates with a male-coupling element such as coupler 20. In FIG. 2A, two such secondary components 30 are provided, each connected between adjacent ends of the center-piece component 12 and a respective end-piece component. When these two secondary components are attached as shown in FIG. 2A, there is formed a "three-sectional staff", which allows relative rotational movement between each end-piece component and the center-piece component, as shown in FIG. 2B. This same flexible-link component 30 may be connected between the two end-piece components 14 and 16 only, as shown in FIG. 2C, to form what is called a "nunchaku" 32, which, in use, allows one end-piece component to be reeled around while the other end-piece component serves as the handle therefor. Alternatively, the nunchaku 32 may be formed using one-end-piece component and the center-piece component.

Another additional, secondary component is shown in FIG. 3A, and is indicated by reference numeral 40. This is a spear-tip component having a tip 40' formed into the shape of a spear, and having an end 40" provided with a male-coupling element 42, for example, for attachment to a female-coupling element of the center-piece component 12 or end-piece component 14. In the spear-tip component shown in FIG. 3A, the tip 40' is shown capable of being removed from the shaft of the component 40, though a fixed joinder therebetween is possible, and, at times, preferable. When the spear-tip component is combined with the center-piece component and/or an end-piece component, a spear is formed, as shown in FIG. 3A. Other blade-components are also provided as secondary components, such as the blade called a "sai" 50 shown in FIG. 3B, or the blade called a "double-hook Chinese Lance" 52 shown in FIG. 3C. Any other desired blade-shape for the tip of the secondary component is possible and falling within the scope and purview of the present invention. FIG. 3D shows still another blade-component 58 having a sickle-shaped blade 60 adjacent one end thereof. Each end 62 and 64 is preferably provided with a coupling element, preferably one female and one male, for attaching each end to a mating end of one of the end-piece components or center-piece component. In typical use, only one end of the component 58 is coupled to one of the three basic components 12, 14 and 16, and, usually, when no other secondary components are used with the component 60, the end 62 is the end attached, leaving the blade 60 free. In this use of the component 58, the weapon is called a "kama", after the name of the sickle-like tool used as a weapon by Okinawan farmers centuries ago. In combination with the kama is another chain-like secondary component 70 similar to the flexible-link component 30 but having a longer chain 70', which in combination with the kama forms what is called a "bakahatsugama". The chain-component 70 is provided at one end with a first coupling element 72 for attachment to the end 62 of the kama 58, and an elongated handle 74 at the other end thereof, by which one may grip the weapon by a hand and swing the bladed kama in circular fashion. Preferably, the handle 74 is also provided with a coupling element for engagement with a mating coupling element on an end of one of the three basic components 12, 14, and 16 to effectively lengthen the handle portion of the weapon.

Another additional, secondary component is shown in FIG. 4A, and is indicated by reference numeral 78. This component, called a "shikibo", is the same as the center-piece component 12 with the addition of a ring or loop 78' made of leather or plastic formed adjacent an end thereof. The ring 78' allows for the insertion therein of a finger so that the component may be twirled in baton-fashion. The ends of the component 78 are provided with coupling elements 18 and 20 just as in the center-piece component 12, so that longer weapons may be formed and twirled. FIG. 4B shows another additional, secondary component 80 called a "mace-and-chain", and has a spiked, spherical end 82, and an end 84 with a coupling element thereof, which ends are interconnected by a chain 86. The coupling element at the end 84 is attachable to a mating coupling element of one of the three basic components 12, 14 and 16, so that the spiked sphere 82 may be reeled about in a circle, in the manner that a mace-and-chain is used. Preferably, this component 80 is attached to the bo shown in FIG. 1A, with the ends 17 and 19 of the end-piece components 14 and 16 also being provided with coupling elements, so that the coupling element on the end 84 of the component 80 may be attached to one of these ends 17 and 19, in order to form a very long weapon having a mace-and-chain at one end thereof. These ends 17 and 19 of the end-piece components 14 and 16, thus being provided also with coupling elements, may also serve to mount other secondary components. Preferably, each end 17 and 19 is provided with a type of coupler opposite to that at the other end of the same end-piece component, so that each end-piece component has one male-coupler and one female-coupler.

Another additional, secondary component is shown in FIG. 4C, and is indicated by reference numeral 88. This component, termed a "Converta Chuck Adapter", is somewhat similar to the flexible-link component 30. However, it is different from the component 30 in that its two coupling elements 90 and 92 are matingly-formed on the inner ends thereof. That is, the end 94' of the chain 94 is secured within an inner, threaded, hollow interior 90' of the coupling element 90, while the other end 94'' of the chain is secured to a projecting threaded portion 92' of the coupling element 92. This projecting threaded portion 92' is matingly-received in a threaded, hollow opening 94', so that the chain 94 may be concealed within the hollow interior of the coupling element 90, and easily exposed and extended by unscrewing the projecting portion 92' therefrom. The coupling elements 90 and 92 are attached to respective ends of two basic components. The resulting weapon is called a "Converta-Chuck".

The component 70 shown in FIG. 5A, called an extended nunchaku using two elongated center-piece components connected together by their couplers 72 between two chain components. Either of the two handle-portions 74 may be connected to an end of one of the three basic components, with the other handle-portion being left free for swinging movement, for swinging about a limb of a person, and the like.

FIG. 5B shows another martial-arts weapon that may be formed by using the center piece 12, end-piece component 14, and the chain component 30 of FIG. 2A. This weapon is called a "sau tsa kuen", and is used so that the chain-component 30 may be reeled about in self-defense.

FIG. 6 shows another martial-arts weapon that may be formed with the components of the present invention. This weapon is called a "pugil stick", and is the same as the bo of FIG. 1A, with the addition of foam-pad components 100 attached to the ends of the end-piece components remote from the center-piece component 12. This weapon is primarily used in military training for combat personnel. Each foam-pad component is made of canvas wrapped about a cotton core, and has its own coupling element for mating with a respective end of an end-piece component.

Each end-cap component 24 may also be weighted, as shown in FIG. 7, in order to allow a martial-arts practitioner to practice his exercise with a bo, or any of the other weapons, so as to establish stamina and power. This weighted end-cap is not used during a competition. While all of the coupling elements of the components of the present invention have been shown as being a threaded male-type or female-type element, a bayonet-type mount may be used instead. Tabs of a male-type mount project from the circumference of a main, projecting connecting piece which is received in a female-type mount having a receptacle provided with a spiral channel for the guiding and holding the tabs therein, in a conventional manner.

While a specific embodiment has been shown and described, it is to be understood that numerous changes and modifications may be made without departing from the scope, spirit, and intent of the invention as set out in the appended claims. Each coupling element may be removably mounted to a respective end of a component so that it may be replaced with a coupling element of opposite sense, to allow for each end of a component to accomodate any type of male or female coupling element.

What is claimed is:

1. A knockdown, re-combinative martial-arts weapon comprising in combination:

an elongated center component having a first end comprising a first coupling element thereof, and a second end comprising a second coupling element thereof, each said coupling element allowing attachment of the respective end of said center component to an end of another component having a mating coupling element thereof;

a first elongated end-piece component having a first end comprising a third coupling element thereof for mating engagement with another end of a different component, and a second end remote from said first end;

at least one flexible-link component having a first end comprising a fourth coupling element for attachment to an end of one of said first elongated end-piece component and said elongated center component, and a second end remote from said first end; said flexible-link component comprising a flexible, elongated member that is capable of winding around an object at which it was thrown, said flexible, elongated member comprising one end secured to said fourth coupling element, and another end remote from said one end;

whereby said components may be interchangeably arranged to form different martial-arts weapons;

said flexible-link component comprising a fifth coupling element, said another end of said flexible, elongated member being secured to said fifth coupling element, such that said flexible-link component is capable of being connected between one end of said center component and one end of said end-piece component, so that said end-piece component and said center component may be moved relative to each other about said flexible, elongated member of said flexible-link member;

said fourth coupling element of said flexible-link component comprising at least a partially-hollow interior on the face thereof facing said fifth coupling element when said flexible-link component is extended linearly along a line, said one end of said flexible elongated member being attached within said hollow interior; said fourth coupling element having an opening at the end thereof; and said fifth coupling element comprising a projecting portion for mating engagement in said opening of said fourth coupling element, so that said flexible member may be hidden and stored in said hollow interior of said fourth coupling element when said projecting portion is inserted into said opening, and may be alternatively exposed and extended for use by which said end-piece component and said center component may be given relative movement therebetween via the adjacent ends connected to the ends of said flexible-link component.

2. The martial-arts weapon according to claim 1, further comprising a second end-piece component having a first end comprising a sixth coupling element for attachment to an end of one of said center component and said first end-piece component.

3. The martial-arts weapon according to claim 1, further comprising at least one foam-pad component comprising a sixth coupling element for attachment to an end of one of said end-piece components and said center-piece component.

4. The martial-arts weapon according to claim 3, wherein each of said end-piece components comprises a coupling element at each end thereof; and comprising two said foam-pad components for attachment to the remote ends of said end-piece components not connected to an end of said center-piece component.

5. The martial-arts weapon according to claim 1, wherein said flexible, elongated member of each said flexible-link components comprises a chain.

6. The martial-arts weapon according to claim 1, wherein said center-piece component comprises a handle portion adjacent one of the ends of said center-piece components by which said center-piece component may be gripped; said first end of said flexible-link member being attached to the other end of said center-piece remote from said one end thereof adjacent said handle portion.

* * * * *